US005316901A

United States Patent [19]

Vacca et al.

[11] Patent Number: 5,316,901

[45] Date of Patent: May 31, 1994

[54] NEGATIVE-ACTING SILVER HALIDE PHOTOGRAPHIC ELEMENTS HAVING EXTENDED UV EXPOSURE LATITUDE

[75] Inventors: Alberto Vacca, Carcare; Aldo Sgarbi, Cairo Montenotte, both of Italy

[73] Assignee: Minnesota Mining and Manufacturing Company, St. Paul, Minn.

[21] Appl. No.: 912,777

[22] Filed: Jul. 13, 1992

[30] Foreign Application Priority Data

Jul. 30, 1991 [IT] Italy ..... MI91A002108

[51] Int. Cl.[5] ..... G03C 1/06

[52] U.S. Cl. ..... 430/512; 430/513; 430/517; 430/931

[58] Field of Search ..... 430/512, 513, , 510, 430/517, 931

[56] References Cited

U.S. PATENT DOCUMENTS

| | | | |
|---|---|---|---|
| Re. 30,303 | 6/1980 | Weber, II et al. | 430/512 |
| 4,307,183 | 12/1981 | Delfino | 430/495 |
| 4,307,184 | 12/1981 | Beretta et al. | 430/512 |
| 4,472,497 | 9/1984 | Kitchin et al. | 430/606 |
| 4,576,908 | 3/1986 | Vallarino | 430/512 |
| 4,849,326 | 7/1989 | Besio et al. | 430/512 |
| 4,946,768 | 8/1990 | Vallerino | 430/512 |

FOREIGN PATENT DOCUMENTS

| | | |
|---|---|---|
| 0219010 | 4/1987 | European Pat. Off. . |
| 0295945 | 12/1988 | European Pat. Off. . |
| 0300257 | 1/1989 | European Pat. Off. . |
| 0411819 | 2/1991 | European Pat. Off. . |
| 0411819A2 | 6/1991 | European Pat. Off. . |

*Primary Examiner*—Jack P. Brammer

*Attorney, Agent, or Firm*—Gary L. Griswold; Walter N. Kirn; Mark A. Litman

[57] ABSTRACT

UV-sensitive negative acting silver halide photographic elements for contact processes which can be safely handled under white light and have increased UV exposure latitude, said elements comprising a support base, a hydrophilic colloidal silver halide emulsion layer comprising UV sensitive negative acting silver halide grains, and one or more hydrophilic colloidal layers, wherein said silver halide emulsion is reactively associated with a water-removable UV-absorbing compound having at least 80% of the absorption in the range from 350 to 400 micronmeter.

7 Claims, No Drawings

NEGATIVE-ACTING SILVER HALIDE PHOTOGRAPHIC ELEMENTS HAVING EXTENDED UV EXPOSURE LATITUDE

FIELD OF THE INVENTION

The present invention relates to UV sensitive negative acting silver halide photographic elements, and more particularly to UV sensitive negative acting silver halide photographic elements which have extended UV exposure latitude.

BACKGROUND OF THE ART

In recent years, in the field of Graphic Arts, new negative acting silver halide photographic elements for duplicating and contacting processes have been introduced. These elements are designed for exposure to UV light on high powered contact frames which are available for exposing lithographic plates and may be handled in ordinary room light (typically in bright white lighting, in which the term "white light" is defined as the emission of a typical commercially available fluorescent lamp).

It is very desirable to produce silver halide photographic elements for duplicating and contacting processes which may be handled safely in bright white light. The benefits of this include ease of working and inspection of the element during exposure and processing, and generally more pleasant working conditions for the operators.

Negative acting silver halide elements which are intended for exposure to UV emitting lamps (such as metal halide lamps) may be afforded some degree of white light handeability by the use of filter dyes either in the emulsion layer or in a non light-sensitive layer. Typically, the dye will particularly absorb visible light and prevent exposure of the radiation sensitive layer by this light. The filter dye is chosen not to greatly interfere with intentional exposure to UV radiations. Examples of silver halide elements incorporating said filter dyes are disclosed in U.S. Pat. Nos. 4,140,531, 4,232,116 and 4,495,274 and EP Pat. Application No. 146,302 where blue absorbing dyes are used which are bleachable during processing.

Additionally, when contacting scanner positive or negative separations, the main objective of a negative acting silver halide photographic element is to obtain a faithful reproduction of the tonal curve. On the other hand, it is normal practice in the field of Graphic Arts to overexpose the first contact to minimize as much as possible retouching and eliminate dirt, spots and paste-up lines. These two objective, that is tonal reproduction and overexposure, are contradictory, i.e., by increasing exposure beyond the optimum time it is possible to eliminate dirt, etc., but a change of dot sizes and the tonal reproduction curve occurs.

Therefore, there is a need in the duplicating and contacting films in the field of Graphic Arts to provide UV sensitive negative acting silver halide photographic elements which have extended exposure latitude to UV light.

Reissue U.S. Pat. No. 30,303 describes UV absorbing dyes useful as filter dyes in photographic elements. The claims are for molecules of the type

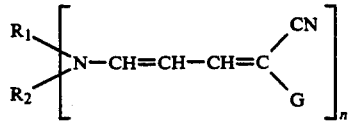

wherein n is 1 or 2, when n is 1 $R_1$ and $R_2$ are independently chosen to represent hydrogen, an alkyl group of 1 to 10 carbon atoms, or a cyclic alkyl group of 5 to 6 carbon atoms provided that $R_1$ and $R_2$ cannot both be hydrogen, or $R_1$ and $R_2$ taken together represent the atoms necessary to complete a cyclic amino group, and when n is 2 at least one of $R_1$ and $R_2$ is alkylene, and G represents an electron withdrawing group.

They are incorporated in silver halide layer(s) or in an UV filter layer of a photographic element. Alternatively, they can be in the film support of the photographic element. The examples given refer to color negative coatings, though black and white constructions are not excluded. No mention is made of water solubilization or bleachability. Their use is to protect the film of unwanted UV exposure and give a more balanced color rendition.

Similar abilities are described in U.S. Pat. Nos. 4,307,184; 4,576,908 and 4,946,768. The first patent refers to polymeric versions of the above dye class and is fairly far removed from our proposed use. The second patent refers to particular versions of formula above in which $R_1$ and $R_2$ are allyl groups. The third patent refers to particular versions of the formula above in which $R_1$ is a short $C_1$–$C_3$ alkyl chain and $R_2$ is a long alkyl chain $>C_{10}$. Advantages are claimed for improved absorption profiles and reduced speed loss compared to the derivatives claimed in Reissue U.S. Pat. No. 30,303. Again their main application is for UV filter dyes in the color negative constructions. Said dyes are hydrophobic and presumably would not be bleached in processing. In fact they are usually preferred to be non-bleachable and nondiffusing to give UV protection after processing. In U.S. Pat. No. 4,307,183 the supersensitizing combination of a polymeric version of formula above with a methine spectral sensitizer in silver halide constructions is claimed.

Of more relevance is U.S. Pat. No. 4,849,326 where water soluble versions of the above dyes are claimed in direct positive (black and white) silver halide constructions. A general formula of water solubilization is used which makes it novel compared to the class and uses disclosed in Reissue U.S. Pat. No. 30,303. Advantages are claimed for improved white light safety with minimal residual UV stain after processing. Water soluble versions of the above dyes are also described in EP Patent Application No. 411,819 for use as antihalation dyes in backing layers of UV-sensitive negative acting silver halide photographic elements. Advantages are claimed for improved dry etching characteristics. In both such references there are no teachings or suggestions that said dyes could be used to improve UV exposure latitude of a UV-sensitive negative acting silver halide photographic element for contact processes, as desired.

SUMMARY OF THE INVENTION

According to the present invention, there is provided a UV sensitive negative acting silver halide photographic element for contact processes which have increased UV exposure latitude. Said element comprises a support, a hydrophilic colloidal silver halide emulsion layer comprising UV sensitive negative acting silver halide grains, and one or more hydrophilic colloidal layers, wherein said silver halide emulsion is reactively associated with a water removable UV absorbing compound having at least 80% of absorption in the range of 350 to 400 micronmeters.

The two requirements in the present invention are 1) that the UV dye must be present in the negative acting silver halide emulsion layer or in a layer coated onto the support on the same side of the emulsion layer for increasing the exposure latitude, and 2) the UV dye be removed during the chemical processing for optimal subsequent contact exposures.

According to the present invention, it has been found that when half-tone images produced from an overexposed first contact are used to produce a second contact, generally with the same exposure time used for the first contact, an exact reproduction of the original scanner reproduction can be obtained.

DETAILED DESCRIPTION OF THE INVENTION

The present invention relates to a UV sensitive negative acting silver halide photographic element comprising a support, a hydrophilic colloidal silver halide emulsion layer comprising UV sensitive negative acting silver halide grains, and one or more hydrophilic colloidal layers, wherein said silver halide emulsion is reactively associated with a water removable UV absorbing compound having at least 80% of absorption in the range of 350 to 400 micronmeters.

Preferably, the UV absorbing compounds for use in the negative acting silver halide photographic element according to the present invention correspond to the general formula:

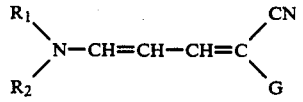

(I)

in which:

$R_1$ and $R_2$,the same or different, each represents an alkyl group, an aryl group or a cyclic alkyl group, or $R_1$ and $R_2$ taken together represent the atoms necessary to complete a cyclic amino group, G represents an electron withdrawing group, and at least one of $R_1$ , $R_2$ and G is substituted with a water solubilizing group.

In the above general formula (I):

$R_1$ and $R_2$ can be the same or different and represent alkyl groups, preferably alkyl groups having 1 to 10 carbon atoms, more preferably alkyl groups having 1 to 4 carbon atoms, including substituted alkyl groups such as cyanoalkyl or alkoxyalkyl groups, aryl groups, preferably aryl groups having 6 to 20 carbon atoms, more preferably aryl groups having 6 to 10 carbon atoms or cyclic alkyl groups, preferably cyclic alkyl groups having 5 or 6 carbon atoms or $R_1$ and $R_2$ taken together represent the elements necessary to complete a cyclic amino group such as, for example, a piperidino, a morpholino, a pyrrolidino, a hexahydroazepino and a piperazino group, G represents an electron withdrawing group of any electron withdrawing groups known in the art such as, for example, CN, $NO_2$,COOR or $SO_2R$ wherein R represents an alkyl group, preferably an alkyl group having 1 to 10 carbon atoms, more preferably an alkyl group having 1 to 4 carbon atoms, or an aryl group (such as phenyl or naphthyl), preferably an aryl group having 6 to 20 carbon atoms, more preferably an aryl group having 6 to 10 carbon atoms, and at least one of $R_1$, $R_2$ and G is substituted with a water solubilizing group of any water solubilizing groups known in the art such as, for example, a COOH group or an alkaline metal or aonium salt thereof, a $SO_3H$ group or an alkaline metal or aonium salt thereof, a hydroxy group, a quaternary aonium salt containing group, a phosphate group or a polyoxyalkylene group.

More preferably, the UV absorbing compounds for use in the negative acting silver halide photographic elements according to the present invention correspond to the general formula:

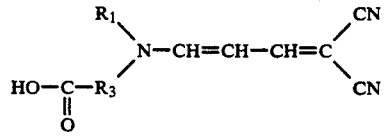

(II)

in which:

$R_1$ represents an alkyl group having 1 to 10 carbon atoms, preferably a lower alkyl group having 1 to 4 carbon atoms such as, for example, methyl, ethyl, propyl, isopropyl, butyl, isobutyl or tert.-butyl group, and $R_3$ represents an alkylene group having 1 to 10 carbon atoms whose carbon atom chain may comprise divalent groups such as, for example, —O—, —S—, —COO— or —$SO_2$—.

The UV absorbing compounds of the photographic elements according to the present invention have a strong absorption in the region of the electromagnetic spectrum at the boundary between the UV and the visible region. The UV absorbing compounds according to this invention have a peak or plateau in their absorbing spectra around 380 micronmeters. At least 80% of their absorption is in the range of from 350 to 400 micronmeters, their absorption below 350 micronmeters being such as not to affect significantly the response of the silver halide emulsion to the UV radiations of the exposure light, preferably such as not to absorb more than 30% of the radiation emitted by exposure lamps. Additionally, the UV absorbing compounds of the photographic elements according to the present invention are highly soluble in water, so that they can be washed out of the element during processing, without a significant retention of UV absorption. Preferably, the absorption of the element in Dmin areas after processing is, in the range from 300 to 400 micronmeters, less than 0.10.

The following are examples of water soluble UV absorbing compounds which are applicable to the present invention:

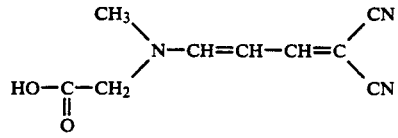

(1)

-continued

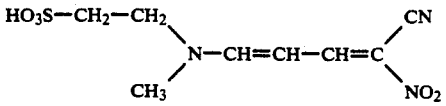

(2)

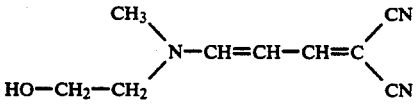

(3)

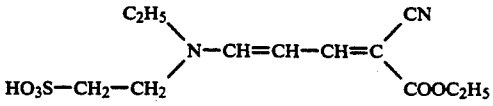

(4)

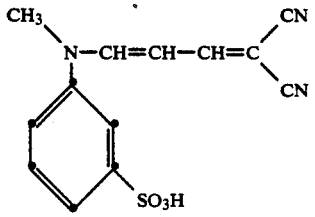

(5)

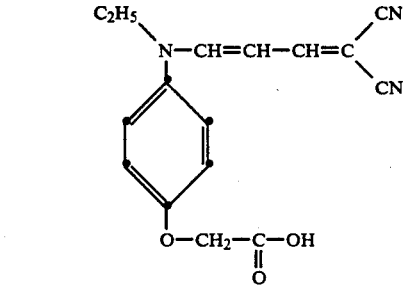

(6)

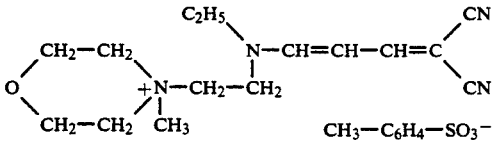

(7)

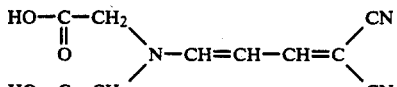

(8)

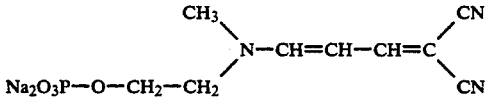

(9)

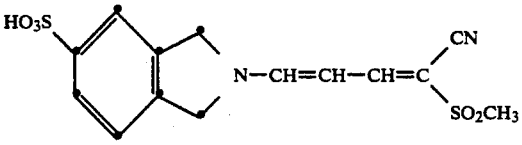

(10)

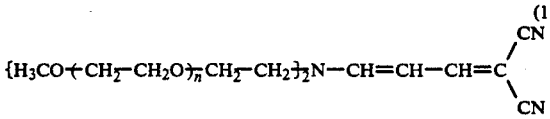

(11)

(wherein n = 12-14)

The UV absorbing compounds of this invention can be prepared according to methods well known in the art. The UV absorbing compounds of general formulas (I) and (II) can be prepared by treating an appropriate amine compound containing the water solubilizing group with an appropriate intermediate in an organic solvent at boiling temperature followed by usual techniques for isolating the compounds. Useful intermediates are for example described in U.S. Pat. No. 4,045,229.

The following is a preparative example of a UV absorbing compound for use in the present invention.

PREPARATIVE EXAMPLE

Compound (I): N-(3-allylidenemalononitrile)-sarcosine

Sarcosine (89.1 grams, 1 mole) was dissolved in 170 ml of water containing NaOH (40 grams, 1 mole) and 450 ml of methanol. Acetanilidoallylidenemalononitrile (216 grams, 0.91 moles) was then added with stirring. The mixture was refluxed for 30 minutes and then cooled in ice. The addition of 100 ml of 37% HCl separated a yellow colored solid that was filtered and crystallized from a 2:1 ethanol-water mixture. The obtained product (112 grams, yield 65%) had a M.P. = 170°-2° C. and a percent analysis for $C_9H_9N_3O$ as follows:

| | N % | C % | H % |
|---|---|---|---|
| Calculated | 21.98 | 56.54 | 4.74 |
| Found | 21.66 | 56.22 | 4.72 |

Spectrophometric analysis: λmax (in water) = 374 micronmeter ε (in water) = 52,000

The product is soluble in water upon addition of a stoichiometric quantity of NaOH.

In the photographic elements of this invention, the UV absorbing compounds are used in an hydrophilic colloidal silver halide emulsion layer and/or an adjacent hydrophilic colloidal layer. Preferably said adjacent layer is nearer to exposure light source than the silver halide emulsion layer. In order to incorporate the UV absorbing compounds into an hydrophilic colloidal layer of the silver halide photographic elements according to this invention, they may be added in the form of a water solution to the hydrophilic colloidal coating composition of a silver halide emulsion layer and/or an adjacent layer. The adding quantity of the UV absorbing compounds, although different according to the type of the compound or of silver halide emulsion to be used, is generally from 0.0001 to 0.1 moles per mole of silver halide, and preferably from 0.001 to 0.01 moles per mole of silver halide. In case of addition to the silver halide emulsion layer, the addition may be made in any step of the process for preparing the UV sensitive negative acting silver halide emulsion, preferably after having completed the second ripening and before coating.

It is well known in the art that silver halides have a high natural sensitivity to UV radiations and that silver bromide also has a relatively high sensitivity to blue and shorter wavelength visible light, while silver chloride has a relatively low sensitivity to blue and to shorter wavelength visible light. Therefore, silver halide emulsions for use in the UV sensitive negative acting photographic elements according to this invention may be preferably selected from high chloride silver halide emulsions. They preferably contain at least 50% mole and more preferably at least 75% mole of silver chloride, the higher the silver chloride content, the lower the natural blue and visible light sensitivity, even if the UV radiation sensitivity remains high. More preferably, the silver halide emulsions to be used in UV sensitive negative acting type photographic elements according to the present invention are emulsions wherein at least 75% by weight of all silver halide grains are silver halide grains wherein at least at 80% mole is silver chloride. The remaining silver halide, if any, will be silver bromide and/or silver iodide but the latter should normally be present in an amount not exceeding 1% mole. In the present invention, it may be useful to combine the UV absorbing compounds according to this invention with dyes capable of absorbing visible radiations so that the photographic element can be safely handled in bright light conditions. The dyes include, for example, oxonol dyes, benzylidene dyes, and the like, which can be bleachable or washable during processing. Examples of useful dyes are described, for example, in U.S. Pat. No. 4,140,531. In conventional emulsions sensitizing dyes are used to extend the sensitivity of the emulsion to longer wavelengths of visible light. This is not required with the emulsions used in the present invention. It also appears to be desirable for the high chloride silver halide emulsions to have a relatively small grain size, e.g. a mean grain size of from 0.05 to 0.6 micron, the preferred grain size being in the range of from 0.05 to 0.3 microns and the most preferred being from 0.05 to 0.1 micron. The high chloride silver halide grains preferably have a cubic shape, but may have other shapes, such as octahedra, spheres, tabular shapes, etc.

In the present invention, silver halides may be prepared in the presence of at least a doping metallic element of the 8th Group of the Periodic Table of Elements, such as rhodium, iridium and ruthenium, which acts as electron acceptor. Said doping element is preferably chosen among water-soluble iridium salts or water-soluble rhodium salts. Iridium salts include iridium and alkaline metal halides, such as potassium iridium (III) hexachloride and sodium iridium (III) hexabromide. Rhodium salts include rhodium halides, such as rhodium (III) trichloride and rhodium (IV) tetrachloride and rhodium and alkaline metal halides such as potassium rhodium (III) hexabromide and sodium rhodium (III) hexachloride. These salts may be added in a quantity of from $0.5\times10^{-4}$ to $10\times10^{-4}$ moles, and preferably from $2\times10^{-4}$ to $7\times10^{-4}$ moles per mole of silver halide.

Gold compounds, used for chemical sensitization, include alkali metal chloroaurates, chloroauric acid, gold sulfide, gold selenide, and the like. Said gold compounds are generally used in a quantity of from $1\times10^{-6}$ to $1\times10^{-4}$ moles per mole of silver halide.

The UV sensitive negative acting silver halide emulsions of the photographic elements according to this invention may contain various other photographic additives which include desensitizers, solarization accelerators, stabilizers, hardeners, coating aids, preservatives, matting agents, antistatic agents, and the like, as described, for example, in U.S. Pat. No. 4,495,274.

Gelatin is generally used as hydrophilic colloid for the silver halide photographic elements of the present invention. As hydrophilic colloids, gelatin derivatives, natural substances such as albumin, casein, agar-agar, alginic acid and the like, and hydrophilic polymers such as polyvinyl alcohol, polyvinylpyrolidone, cellulose ethers, partially hydrolized polyvinyl acetate, and the like can be used in addition to or instead of gelatin. Further, gelatin can be partially substituted with polymer latexes obtained by emulsion polymerization of vinyl monomers, such as polyethylacrylate latexes, to improve the physical characteristics of the photographic layers.

Support bases used in the direct-positive silver halide photographic elements according to this invention can be any of the conventionally used support bases, such as glass, cloth, metal, film including for example cellulose acetate, cellulose acetate-butyrate, cellulose nitrate, polyester, polyamine, polystyrene, and the like, paper including baryta-coated paper, resin-coated paper, and the like.

The negative acting silver halide photographic elements according to this invention may be used in the field of Graphic Arts for various purposes, such as, for example, for contacting, for reproduction, for making offset printing masters, as well as in radiography for special purposes, in electron photography, and the like, where high UV sensitivity is required together with low blue light sensitivity.

The negative acting silver halide photographic elements according to this invention are highly UV sensitive and give high contrast and low minimum density (fog) when they are exposed with light rich in UV rays, and have extended UV exposure latitude.

These and other advantages according to the present invention will be illustrated with reference to the following example.

EXAMPLE

A silver halide emulsion containing 98% mole chloride and 2% mole bromide was prepared by adding simultaneously and under stirring, over a period of 25 minutes, with the double-jet technique, water solution B and water solution C to water gelatin solution A, said water solutions having the

| | |
|---|---|
| Solution A | |
| Water | g 500 |
| Gelatin | g 10 |
| Polyvinylpyrrolidone (K 30) | g 12 |
| Compound: | g 0.25 |

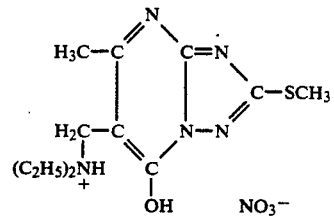

| | |
|---|---|
| $AgNO_3$ (0.1M) | g 40 |
| Solution B | |
| Water | g 250 |
| KBr | g 2.6 |
| KCl | g 80 |
| Solution C | |
| Water | g 133 |
| $AgNO_3$ | g 170 |

The gelatin solution was kept at constant temperature of 35° C. The addition rate of solution C was constant, while the addition rate of solution B varied such as to maintain the millivolt of the emulsion thus formed at a value of 380±10 mv measured with a specific electrode for Br ion and a reference electrode of the saturated Ag/AgCl type. The emulsion, wherein the soluble salts had been removed with the conventional coagulation method, had a mean grain diameter of 0.08 micronmeter. Further additions were made to the individual portions as indicated in Table 1, followed by coating, at a silver coating weight of 2.3 g/m$^2$, onto a polyethylene terephthalate support base which was backed with a green antihalation layer. The films were exposed through a 0.15 continuous wedge. The exposing lamp was a Philips HPA 2000 UV lamp and the films were exposed for 10" at 1 meter distance. The room light was that of an Osram 40W type 21 Lumilux TM white lamp.

The exposed films were developed in 3M RDC Developer for 20" at 40° C. and fixed in 3M Fixroll Fixer. The following Table 1 reports the speed at density of 1 (D1), toe contrast (D2), medium contrast (D3), D-min (D4) and D-max (D5).

TABLE 1

| Film | Dye | Amount g/m$^2$ | D1 | D2 | D3 | D4 | D5 |
|---|---|---|---|---|---|---|---|
| 1 | Dye A | 0.1065 | 0.49 | 3.32 | 7.80 | 0.04 | >5.0 |
| 2 | Dye A + Comp.(1) | 0.1065 0.0232 | 0.34 | 3.46 | 7.00 | 0.04 | >5.0 |
| 3 | Dye A + Comp.(1) | 0.1065 0.0464 | 0.19 | 3.21 | 6.50 | 0.04 | >5.0 |

Next the exposure latitude characteristics were examined which demonstrate the resulting improvement by incorporating the UV absorbing compound into the negative acting silver halide emulsion.

In order to evaluate the exposure latitude characteristics, it was first necessary to determine the optimum dot-for-dot exposure using a hard dot original. The optimum contact exposure is that giving a Dmax>4.0 with a sufficient dot reproduction in the midtones. The test consisted of making a first contact exposure at 8x units overexposure (used to eliminate dirt, spots or paste-up lines) and then a second contact exposure at the same contact overexposure measuring the resulting dot enlargement. The following Table 2 reports the 50% dot reproduction (% dot gain) of the above films at the optimum contact exposure and at the first (negative) and second (positive) contact overexposures and shows how dramatically the addition of the UV absorbing compound added to the negative acting emulsion affects the resulting dot reproduction in overexposure contacting.

TABLE 2

| Film | Dye | Optimum Exp. | 1st Overexp. | 2nd Overexp. |
|---|---|---|---|---|
| 1 | Dye A | +6% | +13% | +7% |
| 2 | Dye A + Comp.(1) | +5 | +11 | +1 |
| 3 | Dye A + Comp.(1) | +5 | +11 | +1 |

The Dye A above is an oxonol dye corresponding to the formula:

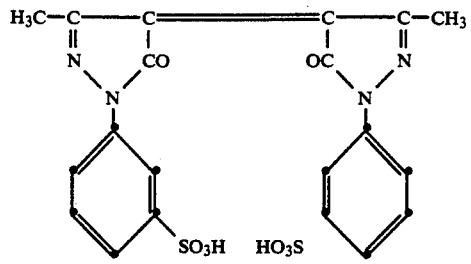

We claim:

1. A UV sensitive negative acting silver halide photographic element comprising a support, a hydrophilic colloidal silver halide emulsion layer comprising UV sensitive negative acting silver halide grains, and one or more hydrophilic colloidal layers, wherein in said silver halide emulsion layer or in a hydrophilic colloid layer adjacent said emulsion layer there is a water soluble UV absorbing compound having at least 80% of absorption in the range of 350 to 400 micrometers.

2. The UV sensitive negative acting silver halide photographic element of claim 1, wherein said UV absorbing compound is represented by the general formula:

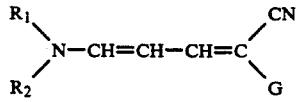

(I)

in which:

$R_1$ and $R_2$, the same or different, each represents an alkyl group, an aryl group or a cyclic alkyl group, or $R_1$ and $R_2$ taken together represent the atoms necessary to complete a cyclic amino group, G represents an electron withdrawing group, and at least one of $R_1$, $R_2$ and G is substituted with a water solubilizing group.

3. The UV sensitive negative acting silver halide photographic element of claim 1, wherein said UV absorbing compound is represented by the general formula:

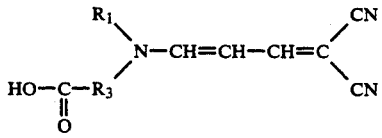

(II)

in which:

$R_1$ represents an alkyl group, and $R_3$ represents an alkylene group.

4. The UV sensitive negative acting silver halide photographic element of claim 1, wherein the added quantity of said water removable UV absorbing compound is in the range from 0.0001 to 0.1 mole per mole of silver halide.

5. The UV sensitive negative acting silver halide photographic element of claim 1, wherein said water removable UV absorbing compound is comprised in the silver halide emulsion layer.

6. The UV sensitive negative acting silver halide photographic element of claim 1, wherein said UV absorbing compound is comprised in a hydrophilic colloid layer positioned on the same side of the support comprising the silver halide emulsion layer.

7. The UV sensitive negative acting silver halide photographic element of claim 1, wherein said silver halide emulsion is a high chloride silver halide emulsion.

* * * * *